US012595918B2

(12) United States Patent
Cheng et al.

(10) Patent No.: US 12,595,918 B2
(45) Date of Patent: Apr. 7, 2026

(54) AIR CONDITIONER INDOOR UNIT AND AIR CONDITIONER

(71) Applicant: GD MIDEA AIR-CONDITIONING EQUIPMENT CO., LTD., Foshan (CN)

(72) Inventors: Rixiong Cheng, Foshan (CN); Zhihui Mu, Foshan (CN); Zhiyong Xu, Foshan (CN); Huajun Zhang, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 618 days.

(21) Appl. No.: 17/794,789

(22) PCT Filed: Nov. 5, 2020

(86) PCT No.: PCT/CN2020/126821
§ 371 (c)(1),
(2) Date: Jul. 22, 2022

(87) PCT Pub. No.: WO2021/159777
PCT Pub. Date: Aug. 19, 2021

(65) Prior Publication Data

US 2023/0097721 A1 Mar. 30, 2023

(30) Foreign Application Priority Data

Feb. 14, 2020 (CN) ..... 202020173517.1

(51) Int. Cl.
*F24F 1/0011* (2019.01)
*F24F 13/15* (2006.01)

(52) U.S. Cl.
CPC ..... *F24F 1/0011* (2013.01); *F24F 13/15* (2013.01)

(58) Field of Classification Search
CPC ..... F24F 1/0011; F24F 13/15; F24F 1/0057; F24F 13/14; F24F 1/0014; F24F 7/10; F24F 13/06
(Continued)

(56) References Cited

U.S. PATENT DOCUMENTS 4,782,999 A * 11/1988 Ishii ..... F24F 11/84 454/258
5,547,018 A * 8/1996 Takahashi ..... F24F 1/0011 454/258
(Continued)

FOREIGN PATENT DOCUMENTS

CN 201281436 Y * 7/2009 ..... F24F 11/30
CN 110608527 A 12/2019
(Continued)

OTHER PUBLICATIONS

Chinese to English translation CN 201281436Y.*
(Continued)

*Primary Examiner* — Michael G Hoang
*Assistant Examiner* — Brett P. Mallon
(74) *Attorney, Agent, or Firm* — Anova Law Group, PLLC

(57) ABSTRACT

An air conditioner indoor unit includes a housing with an air outlet, a volute assembly in the housing and including an upper volute and a lower volute, between which an air outlet duct communicating with the air outlet is formed, and an air deflector rotatably mounted at the air outlet to open or close the air outlet. A middle portion of at least one end of the air deflector in a length direction of the air deflector is rotatably connected to the housing through a rotation shaft, to enable the air deflector to rotate between an upward-opening state and a downward-opening state. In the upward-opening state, a lower side of the air deflector is closer to the upper volute
(Continued)

than to the lower volute. In the downward-opening state, an upper side of the air deflector is closer to the lower volute than to the upper volute.

15 Claims, 6 Drawing Sheets

(58) Field of Classification Search
USPC ..... 454/254
See application file for complete search history.

(56) References Cited

U.S. PATENT DOCUMENTS

| | | | | |
|---|---|---|---|---|
| 2012/0135674 | A1* | 5/2012 | Uehara | F24F 13/20 454/338 |
| 2019/0041085 | A1* | 2/2019 | Kono | F24F 13/1406 |

FOREIGN PATENT DOCUMENTS

| | | | | |
|---|---|---|---|---|
| CN | 209763322 | U | 12/2019 | |
| CN | 209944524 | U | 1/2020 | |
| CN | 209944533 | U | 1/2020 | |
| CN | 110762824 | A | 2/2020 | |
| CN | 211177083 | U | 8/2020 | |
| CN | 211650476 | U | 10/2020 | |
| CN | 211854192 | U | 11/2020 | |
| EP | 3348929 | A1 * | 7/2018 | F24F 13/26 |
| JP | H07318153 | A | 12/1995 | |
| JP | 2002089950 | A | 3/2002 | |
| JP | 2008025880 | A | 2/2008 | |
| WO | 2016063397 | A1 | 4/2016 | |

OTHER PUBLICATIONS

English translation of CN-201281436-Y, dated Sep. 26, 2025 (Year: 2025).*

World Intellectual Property Organization (WIPO) International Search Report and Written Opinion for PCT/CN2020/126821 Jan. 21, 2021 17 pages (with translation).

The European Patent Office (Epo) Extended Search Report for EP Application No. 20918676.6 Jun. 9, 2023 9 Pages.

* cited by examiner

AIR CONDITIONER INDOOR UNIT AND AIR CONDITIONER

CROSS-REFERENCE TO RELATED APPLICATIONS

This application is a National Stage Entry under 35 U.S.C. § 371 of International Application No. PCT/CN2020/126821, filed on Nov. 5, 2020, which claims priority to Chinese patent application No. 202020173517.1, filed on Feb. 14, 2020 and entitled "Air Conditioner Indoor Unit and Air Conditioner." The disclosures of the aforementioned applications are incorporated in this application by reference in their entireties.

TECHNICAL FIELD

The present application relates to the field of air conditioning, in particular to an air conditioner indoor unit and an air conditioner.

BACKGROUND

For existing air conditioners, an air deflector is often provided at the air outlet to control the blowing direction and the blowing angle. However, the angle range of swinging up and down of the air deflector is small, which is generally less than 90 degrees and cannot meet the use requirements of users. Meanwhile, a louver is provided at the air outlet for swinging left and right and increasing a blowing range of left and right. The installation and removal of the louver and the air deflector independent from each other are relatively difficult, and the cleaning is not easy for the users.

The above content is only used to assist in understanding the technical solution of the present application, and does not mean that the above content is recognized as prior art.

SUMMARY

The main purpose of the present application is to provide an air conditioner indoor unit, which aims to solve one or more of the above-mentioned technical problems.

In order to achieve the above purpose, the air conditioner indoor unit provided by the present application includes a housing, a volute assembly, an air deflector and a louver assembly;

the housing is provided with an air outlet;

the volute assembly is disposed in the housing, and the volute assembly includes an upper volute and a lower volute, and an air outlet duct communicating with the air outlet is formed between the upper volute and the lower volute;

the air deflector is rotatably mounted at the air outlet to open or close the air outlet, a middle portion of at least one end of the air deflector in a length direction of the air deflector is rotatably connected to the housing through a rotation shaft, to make the air deflector have an upward-opening state in which the air deflector is rotated around the rotation shaft to bring a lower side of the air deflector to come close to the upper volute and a downward-opening state in which the air deflector is rotated around the rotation shaft to bring an upper side of the air deflector to come close to the lower volute; and the louver assembly is connected to a windward surface of the air deflector.

In an embodiment, the air deflector is configured in an arc shape that protrudes towards an outer side of the air outlet.

In an embodiment, when the air outlet is closed by the air deflector, an edge of the air deflector closer to the upper volute is regarded as an upper edge of the air deflector, and an edge of the air deflector closer to the lower volute is regarded as a lower edge of the air deflector, a distance between an upper edge of the air outlet and a rotation axis of the air deflector is S1, a distance between the upper edge of the air deflector and the rotation axis of the air deflector is L1, and S1 is greater than L1.

In an embodiment, a distance between a lower edge of the air outlet and the rotation axis of the air deflector is S2, a distance between the lower edge of the air deflector and the rotation axis of the air deflector is L2, and S2 is greater than L2.

In an embodiment, S1 is equal to a sum of L1 and a reserved gap, S2 is equal to a sum of L2 and another reserved gap; and wherein the reserved gap and the another reserved gap are greater than or equal to 3 mm and less than or equal to 5 mm.

In an embodiment, when the air deflector is in the downward-opening state, an included angle between the upper edge of the air deflector and a perpendicular line between the upper edge of the air outlet and the rotation axis of the air deflector is greater than or equal to 57 degrees; and/or when the air deflector is in the upward-opening state, an included angle between the lower edge of the air deflector and a perpendicular line between the lower edge of the air outlet and the rotation axis of the air deflector is greater than or equal to 43 degrees.

In an embodiment, the upper volute has an upper arc section connected to the upper edge of the air outlet, the lower volute has a lower arc section connected to the lower edge of the air outlet, a diameter of the upper arc section is equal to a distance from the upper edge of the air outlet to the rotation axis of the air deflector, and a diameter of the lower arc section is equal to a distance from the lower edge of the air outlet to the rotation axis of the air deflector.

In an embodiment, the air deflector includes a peripheral plate and an inner lining plate connected to the peripheral plate, and the louver assembly is rotatably connected to the inner lining plate.

In an embodiment, the air conditioner indoor unit further includes a first driving device and a second driving device mounted at one side or distributed on two sides of the housing in a length direction of the housing, a driving shaft of the first driving device is connected to the air deflector to drive the air deflector to rotate, and the second driving device is in transmission connection with the louver assembly to drive a plurality of louvers of the louver assembly to swing.

In an embodiment, the air deflector is detachably mounted at the housing.

In an embodiment, the louver assembly includes a connection rod and a plurality of louvers connected to the connection rod, and the plurality of louvers are arranged at intervals along the length direction of the air deflector.

The present application further provides an air conditioner, which includes an air conditioner outdoor unit and an air conditioner indoor unit which communicate with each other through a refrigerant pipe, the air conditioner indoor unit includes a housing, a volute assembly, an air deflector and a louver assembly, the housing is provided with an air outlet.

the volute assembly is disposed in the housing, and the volute assembly includes an upper volute and a lower volute, and an air outlet duct communicating with the air outlet is formed between the upper volute and the lower volute;

the air deflector is rotatably mounted at the air outlet to open or close the air outlet, a middle portion of at least one end of the air deflector in a length direction of the air deflector is rotatably connected to the housing through a rotation shaft, to make the air deflector have an upward-opening state in which the air deflector is rotated around the rotation shaft to bring a lower side of the air deflector to come close to the upper volute and a downward-opening state in which the air deflector is rotated around the rotation shaft to bring an upper side of the air deflector to come close to the lower volute; and the louver assembly is connected to a windward surface of the air deflector.

According to the air conditioner indoor unit, the air deflector is rotatably mounted at the air outlet to open or close the air outlet, and a middle portion of at least one end in the length direction of the air deflector is rotatably connected to the housing through a rotation shaft, and makes the air deflector have an upward-opening state and a downward-opening state. In the upward-opening state, the air deflector rotates around the rotation shaft and the lower side of the air deflector comes close to the upper volute, and in the downward-opening state, the upper side of the air deflector comes close to the lower volute. In this way, the air deflector can rotate around the rotation shaft and open the air outlet in the upper and lower directions, that is, the airflow is guided and goes out from both the upper portion and the lower portion of the air outlet, the rotation angle of the air deflector is increased, and the airflow supply angle and the airflow supply range are increased. In addition, by connecting the louver assembly with the windward surface of the air deflector, the air deflector and the louver assembly are modularized, thus the air deflector and the louver assembly can be removed more easily, and the user can clean the airflow guiding structure conveniently.

BRIEF DESCRIPTION OF THE DRAWINGS

In order to more clearly explain the embodiments of the present application or the technical solutions in the related art, the drawings used in the description of the embodiments or the related art will be briefly introduced below. Obviously, the drawings in the following description are merely some embodiments of the present application. For those of ordinary skill in the art, other drawings can be obtained based on the structure shown in these drawings without creative work.

DESCRIPTION OF REFERENCE NUMERALS IN THE FIGURES

Figure 1:
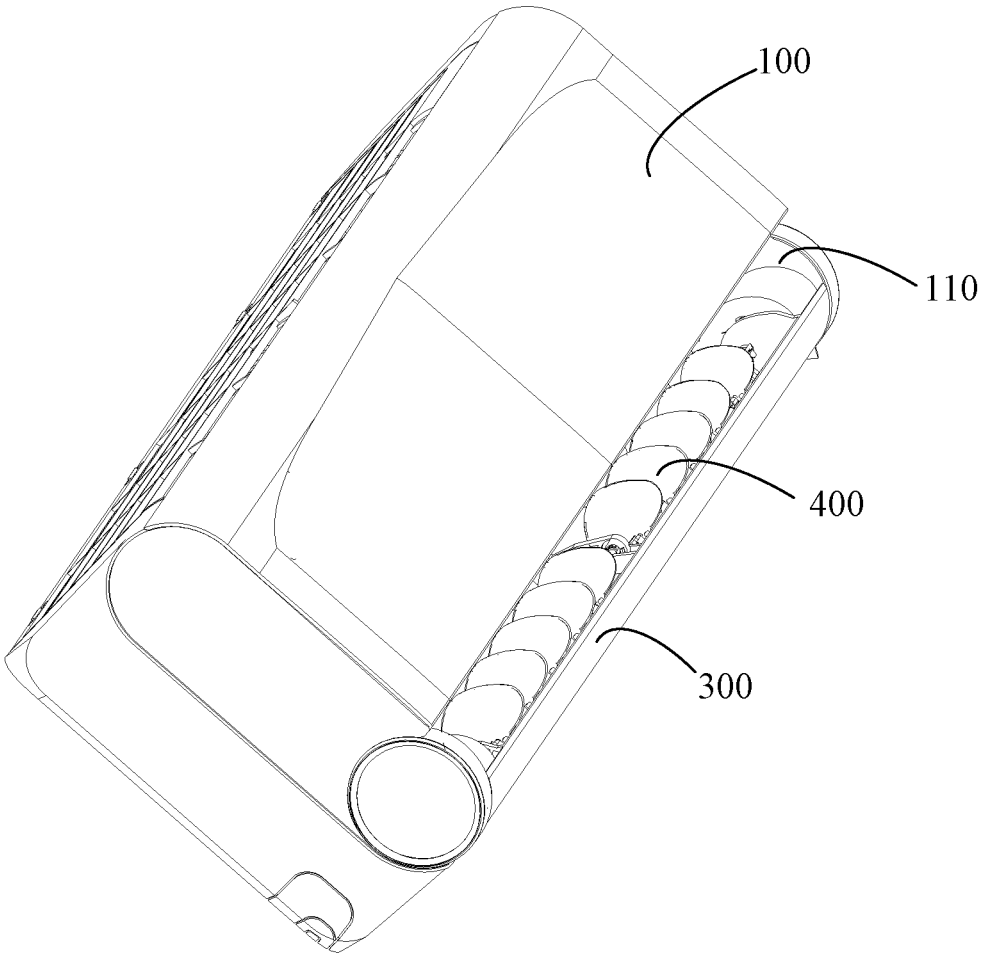
FIG. 1 is a schematic structural view of an air conditioner indoor unit according to an embodiment of this application.
Figure 2:
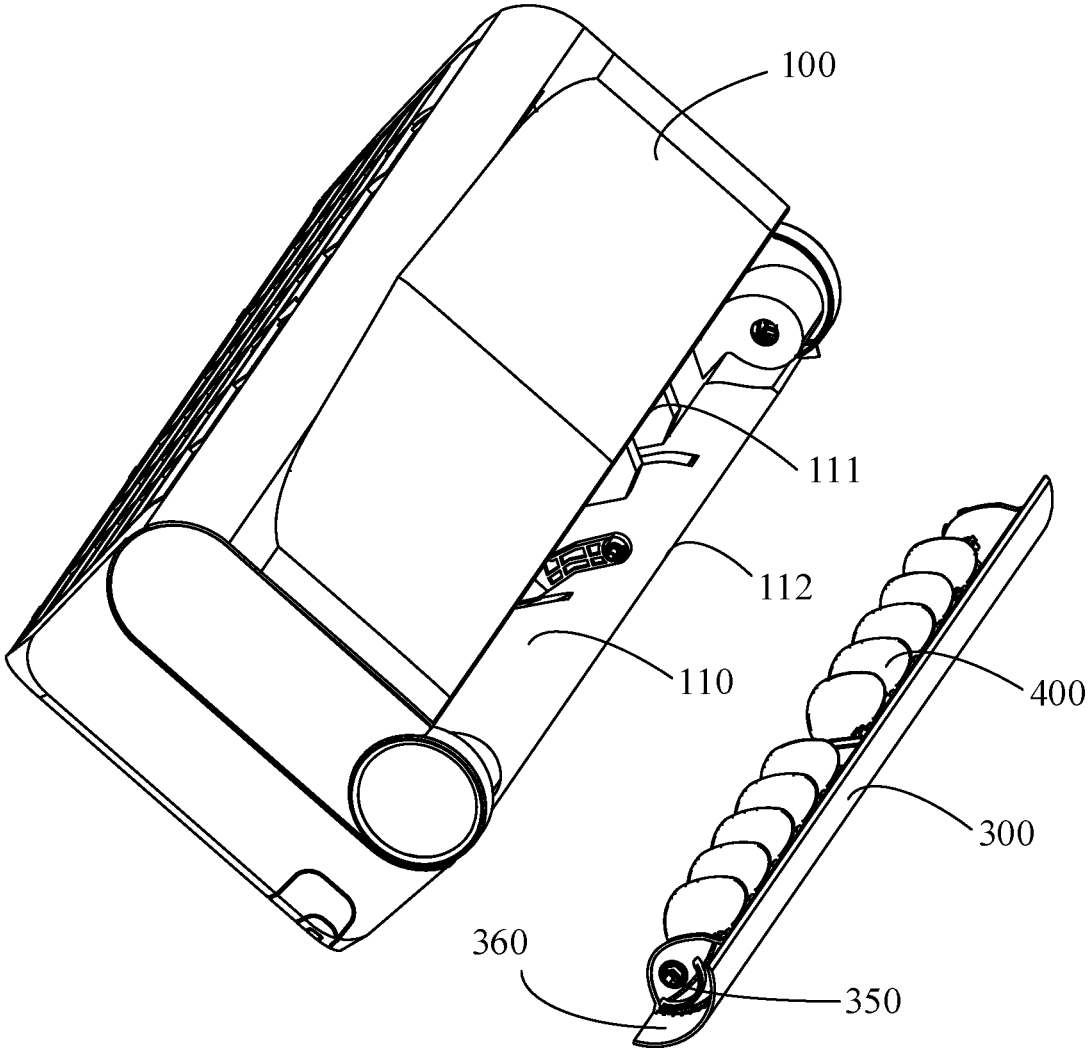
FIG. 2 is a partially exploded view of the air conditioner indoor unit of FIG. 1.
Figure 3:
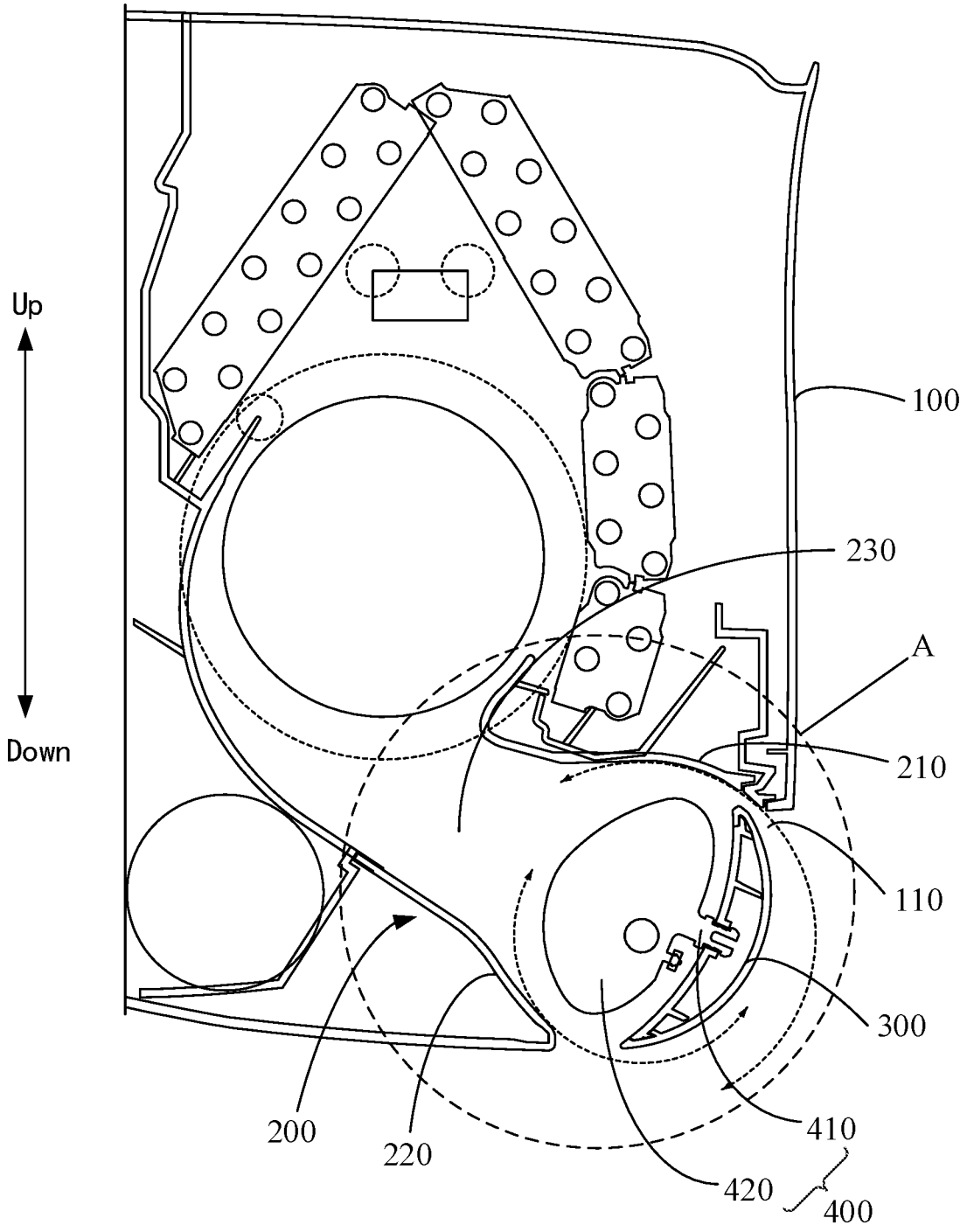
FIG. 3 is a schematic cross-sectional view of the air conditioner indoor unit of FIG. 1.

| Reference numeral | Name | Reference numeral | Name |
|---|---|---|---|
| 100 | Housing | 210 | Upper volute |
| 110 | Air outlet | 211 | Upper arc section |
| 111 | Upper edge of the air outlet | 220 | Lower volute |
| 112 | Lower edge of the air outlet | 221 | Lower arc section |
| 200 | Volute assembly | 300 | Air deflector |
| 310 | Upper edge of the air deflector | 340 | Inner lining plate |
| 320 | Lower edge of the air deflector | 400 | Louver assembly |
| 330 | Peripheral plate | | |

The realization of the purposes, functional features and advantages of the present application will be further explained with reference to the accompanying drawings in combination with the embodiments.

DETAILED DESCRIPTION OF THE EMBODIMENTS

It should be noted that all directional indicators (such as up, down, left, right, front, back, etc.) in the embodiments of the present application are only used to explain the relative positional relationship, movement situation, etc. between components in a specific attitude (as shown in the drawings). If the specific attitude changes, the directional indication also changes accordingly.

In addition, the descriptions related to "first," "second" and the like in the present application are for descriptive purposes only, and should not be understood as indicating or implying their relative importance or implicitly indicating the number of technical features indicated. Therefore, a feature associated by "first" and "second" may explicitly or implicitly include at least one of such feature. In addition, the meaning of "and/or" in the entire text includes three parallel solutions, taking "A and/or B" as an example, it includes solution A, solution B, or both solutions A and B.

The present application provides an air conditioner indoor unit, which is exemplified by taking a wall-mounted air conditioner indoor unit as an example.

In this embodiment of this application, as shown in FIG. 1 to FIG. 6, the air conditioner indoor unit includes a housing 100, a volute assembly 200, an air deflector 300 and a louver assembly 400. The housing 100 is provided with an air outlet 110. The volute assembly 200 includes an upper volute 210 and a lower volute 220, and an air outlet duct 230 in fluid communication with the air outlet 110 is formed between the upper volute 210 and the lower volute 220. The air deflector 300 is rotatably mounted at the air outlet 110 to open or close the air outlet 110. A middle portion of at least one end of the air deflector 300 in a length direction of the air deflector 300 is rotatably connected to the housing 100 via a rotation shaft 350, which enable the air deflector 300 to rotate around the rotation shaft 350 to have an upward-opening state and a downward-opening state. In the upward-opening state, a lower side of the air deflector 300 is rotated to close to the upper volute 210, and in the downward-opening state, an upper side of the air deflector 300 is rotated to close to the lower volute 220. The louver assembly 400 is connected to a windward surface 360 of the air deflector 300.

In this embodiment, the air outlet 110 of the wall-mounted air conditioner indoor unit is generally elongated and extended along a length direction of the housing 100. The length and the width of the air deflector 300 are adapted to the air outlet 110, and the air deflector 300 can open or close the air outlet 110. the whole of the air deflector 300 can be located on an outer side of the air outlet 110 when the air outlet 110 is closed by the air deflector 300, that is, an upper edge of the air deflector 300 is located on an outer side of an upper edge 111 of the air outlet, and a lower edge of the air deflector 300 is located on an outer side of a lower edge 112 of the air outlet. The air deflector 300 may either be located at an inner side of the air outlet 110, that is, an edge of the air outlet 110 is located on an outer side of the air deflector 300. The upper edge of the air deflector 300 can be abutted against the upper edge of the air outlet 110, and the lower edge of the air deflector 300 can be abutted against the lower edge of the air outlet 110. Alternatively, the upper edge 111/lower edge of the air deflector 300 is located on the outer side of the upper edge/lower edge of the air outlet, or the lower edge/upper edge of the air deflector 300 is located on the inner side of the lower edge 112/upper edge of the air outlet. The specific relative positions of the air deflector 300 and the edge of the air outlet 110 may be selected and designed according to actual requirements, which are not listed herein one by one.

The volute assembly 200 is disposed in the housing 100, and the upper volute 210 and the lower volute 220 may be integrally formed, or may be separately formed. The air outlet duct 230 is formed between the upper volute 210 and the lower volute 220. An indoor fan is disposed in the air outlet duct 230, and the fan may be a cross-flow fan. An air outlet end of the volute assembly 200 corresponds to the air outlet 110 of the housing 100. In order to make the airflow circulation smoother, and reduce the airflow resistance, an air outlet edge of the upper volute 210 is connected to the upper edge of the air outlet 110, and an air outlet edge of the lower volute 220 is connected to the lower edge of the air outlet 110. It should be noted that the middle portions of both ends in the length direction of the air deflector 300 refers to a middle portion of the air deflector 300 in a width direction. A middle portion of at least one end of the air deflector 300 in the length direction is rotatably connected to the housing 100 through the rotation shaft 350, and thus each end of the air deflector 300 in the length direction may be provided with a rotation shaft 350, and shaft holes adapted to the rotation shaft 350 are formed at the housing 100, to make the air deflector 300 rotatable about the rotation shaft 350. Of course, the shaft holes may be provided at the two ends of the air deflector 300 in the length direction, and rotation shafts are provided on the housing 100, or a rotation shaft is provided at one end of the air deflector 300 in the length direction, a shaft hole is formed at the other end of the air deflector 300 in the length direction, and a shaft hole and a rotation shaft are correspondingly provided on the housing 100.

The air deflector 300 may be in a flat plate shape, or may be in a convex arc shape, and the specific shape may be selected according to actual use requirements, which is not specifically limited herein. In an embodiment, the air deflector 300 includes a peripheral plate 330 and an inner lining plate 340 connected to the peripheral plate 330, and the louver assembly 400 is rotatably connected to the inner lining plate 340. Connecting the louver assembly 400 to the inner lining plate 340 of the air deflector 300 can improve the strength of the peripheral plate 330 of the air deflector 300 and ensure the air guide reliability of the air deflector 300.

For the middle portions of the ends of the air deflector 300 in the length direction is rotatably connected to the housing 100 through the rotation shafts 350, the rotation shafts 350 are also substantially located in the middle portion of the air outlet 110 in the width direction, thus the air deflector 300 can rotate clockwise and counterclockwise about the rotation shaft 350. That is, the air deflector 300 can rotate upward about the rotation shaft 350 (an upper half portion of the air deflector 300 rotates towards the inner side of the air outlet 110). At this time, the air deflector 300 is in the upward-opening state. The air deflector 300 can also rotate downward around the rotation shaft 350 (a lower half portion of the air deflector 300 rotates towards the inner side of the air outlet 110). At this time, the air deflector 300 is in the downward-opening state. The maximum opening angle of the air deflector 300 in the upward-opening state and the maximum opening angle of the air deflector 300 in the downward-opening state may be selected according to actual use requirements, and are not limited herein. It should be noted that, the lower side of the air deflector 300 being rotated to be close to the upper volute 210 refers to that the lower half portion of the air deflector 300 located on the outer side of the air outlet 110 rotates to come close to the lower volute 220, and the upper side of the air deflector 300 being rotated to be close to the lower volute 220 refers to that the upper half portion of the air deflector 300 located on the outer side of the air outlet 110 rotates to come close to the lower volute 220. When the air deflector 300 is in the upward-opening state, the airflow may go out through both an upper half portion and a lower half portion of the air outlet 110, or only through the lower half portion of the air outlet 110, and the upper side of the air deflector 300 abuts against the upper volute 210 to close the upper half portion of the air outlet 110. Similarly, when the air deflector 300 is in the downward-opening state, the airflow may go out through both the upper half portion and the lower half portion of the air outlet 110, or only through the upper half portion of the air outlet 110, and the lower side of the air deflector 300 abuts against the lower volute 220 to close the lower half portion of the air outlet 110.

The rotation of the air deflector 300 realizes up-and-down airflow guiding, and the swinging of the louver assembly 400 realizes left and right airflow guiding. Thus the airflow supply range of the air outlet 110 in the up-down and left-right directions are increased. A plurality of louvers of the louver assembly 400 can eliminate the vortex of the airflow blown out from the air outlet duct 230, and achieve the effect of noise reduction. The louvers may be rotatably connected to the windward surface 360 of the air deflector 300, such as by pivoting, hinging, or by a universal joint or the like. Specifically, the louver assembly 400 includes a connection rod 410 and the plurality of louvers 420 connected to the connection rod 410. The plurality of louvers 420 are spaced apart along the length direction of the air deflector 300. The windward surface 360 of the air deflector 300 faces the inner side of the air outlet 110. The shape of the louvers 420 is not limited herein, and may be a polygon, a circle or an ellipse. A polygon with curved edges is taken as an example.

The air deflector 300 is rotatably connected to the housing 100 through the rotation shafts 350. In an embodiment, the air deflector 300 is detachably mounted at the housing 100, and the louver assembly 400 can be removed by removing the air deflector 300, thus the removal efficiency and the installation efficiency of the air deflector 300 and the louver assembly 400 are improved. By shifting the louvers 420 or the connection rod 410 manually, the left and right airflow guiding angles of the plurality of louvers 420 can be adjusted. A driving device can be provided for the automatic adjustment of the plurality of louvers 420. The air deflector 300 can be manually switched among the opening states, the closed state, the upward-opening state and the downward-opening state, or be automatically switched by a driving device.

In an embodiment, the air conditioner indoor unit further includes a first driving device and a second driving device. The first driving device and the second driving device are mounted at one or two side(s) of the housing 100 in the length direction. A driving shaft of the first driving device is connected to the air deflector 300 to drive the air deflector 300 to rotate, and the second driving device is in transmission connection with the louver assembly 400 to drive the plurality of louvers 420 of the louver assembly 400 to swing. The first driving device may include a first motor, and the second driving device may include a second motor and a transmission member. The driving shaft of the first motor is connected to the air deflector 300 to drive the air deflector 300 to rotate. The transmission member is in transmission connection with the driving shaft and the connection rod 410 of the second motor, to realize the swinging of the plurality of louvers 420. By arranging the first driving device and the second driving device, automatic rotations of the air deflector 300 and the louver assembly 400 is achieved, the automation degree of the air conditioner indoor unit is improved. In order to make the overall structure of the air conditioner indoor unit more compact, and avoid uneven gravity distribution, the first driving device and the second driving device are distributed on both sides of the housing 100 in the length direction. Therefore, the spatial layout is optimized, and the space occupied by the driving device is reduced.

According to the air conditioner indoor unit of the present application, the air deflector 300 is rotatably mounted at the air outlet 110 to open or close the air outlet 110. The middle portion of at least one end of the air deflector 300 in the length direction is rotatably connected to the housing 100 through the rotation shaft 350, and makes the air deflector 300 have an upward-opening state and a downward-opening state. In the upward-opening state, the air deflector 300 rotates around the rotation shaft 350 and the lower side of the air deflector 300 comes close to the upper volute 210, and in the downward-opening state, the upper side of the air deflector 300 comes close to the lower volute 220. In this way, the air deflector 300 can rotate around the rotation shaft 350 and open the air outlet 110 in the upper and lower directions, that is, the airflow is guided and goes out from both the upper portion and the lower portion of the air outlet, the rotation angle of the air deflector 300 is increased, and the airflow supply angle and the airflow supply range are increased. In addition, by connecting the louver assembly 400 with the windward surface 360 of the air deflector 300, the air deflector 300 and the louver assembly 400 are modularized, thus the air deflector 300 and the louver assembly 400 can be removed more easily, and the user can clean the whole airflow guiding structure. The technical defect that the airflow guiding structure of the existing air conditioner is difficult to be thoroughly cleaned is solved.

In an embodiment, referring to FIG. 2 to FIG. 6, the air deflector 300 is configured in an arc shape protruding toward the outer side of the air outlet 110.

In this embodiment, the air deflector 300 is arc-shaped and protruding towards the outer side of the air outlet 110, thus when the air deflector 300 is in the upward-opening state, a concave surface of the air deflector 300 and the lower volute 220 form the gradually narrowed air outlet duct 230, or when the air deflector 300 is in the downward-opening state, the concave surface of the air deflector 300 and the upper volute 210 form the gradually narrowed air outlet duct 230. The air deflector 300 guides the airflow better, and the airflow goes out more smoothly. Compared with a flat plate having the same rotation angle range, the air deflector 300 in the arc shape and protruding outward has a smaller width, thus the overall structure is more compact.

Meanwhile, when the air deflector 300 is in the upward-opening state, a convex surface of the air deflector 300 is adjacent to the upper volute 210, thus a gap between the upper volute 210 and the air deflector 300 is reduced, or the air deflector 300 abuts against the upper volute 210 and closes the upper half portion of the air outlet 110. The airflow goes out only through the lower half portion and is thus speeded up, and a greater airflow supply distance is obtained. Further, during heating of the air conditioner, the airflow goes into the indoor through the lower half portion, and the airflow is easy to flow downwards, and the floor heating requirement of the users is met. When the air deflector 300 is in the downward-opening state, the convex surface of the air deflector 300 is adjacent to the lower volute 220, thus a gap between the lower volute 220 and the air deflector 300 is reduced, or the air deflector 300 abuts against the lower volute 220 and closes the lower half portion of the air outlet 110. The airflow goes out only through the upper half portion and is thus speeded up, and a greater airflow supply distance is obtained. Further, during cooling of the air conditioner, the airflow goes into the indoor through the upper half portion, thus cold airflow blowing directly to the user is avoided, and the user experience is improved.

Figure 4:
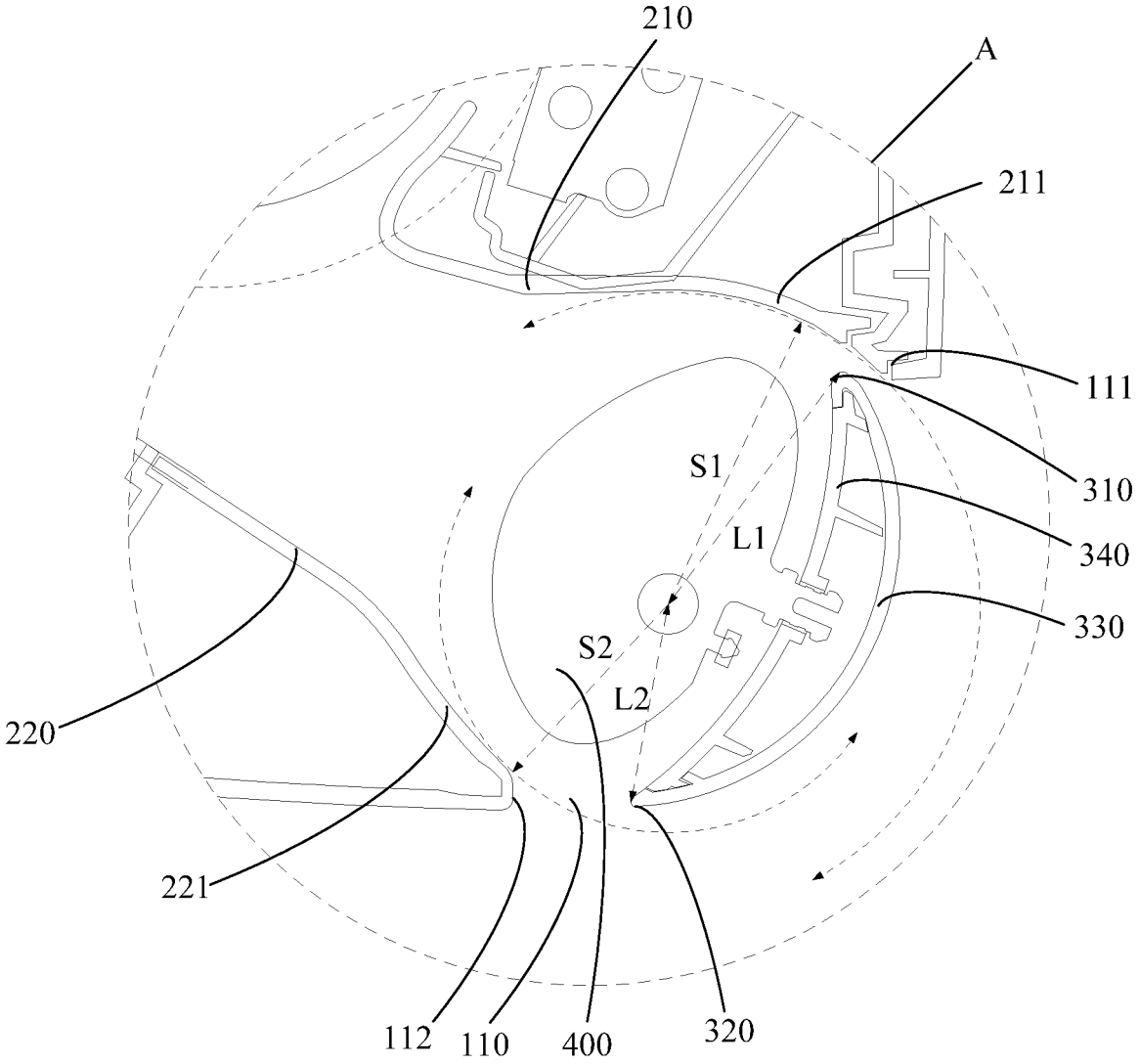
FIG. 4 is a partial enlarged view of portion A in FIG. 3.

On the basis of the above embodiment, further, as shown in FIG. 4, an edge of the air deflector 300 closer to the upper volute 210 is regarded as an upper edge 310 of the air deflector, and an edge of the air deflector 300 closer to the lower volute 220 is regarded as a lower edge 320 of the air deflector when the air outlet 110 is closed by the air deflector 300. A distance between the upper edge 111 of the air outlet and a rotation axis of the air deflector 300 is S1, a distance between the upper edge 310 of the air deflector and the rotation axis of the air deflector 300 is L1, and S1 is greater than L1. It should be noted that, when the air deflector 300, which is in the arc-shape and protruding outwards, is rotated about the rotation shaft 350, the rotation axis thereof is an axis of an arc surface of the air deflector 300. By setting S1 to be greater than L1, the upper edge of the air deflector 300 can rotate from the upper edge of the air outlet 110 to the inner side of the air outlet 110, thereby a lower airflow outlet state of the air deflector 300 is achieved. At this moment, the upper edge of the air deflector 300 may be located on the outer side, or on the inner side, or at the upper edge of the air outlet 110.

Further, a distance between the lower edge 112 of the air outlet and the rotation axis of the air deflector 300 is S2, a distance between the lower edge 320 of the air deflector and the rotation axis of the air deflector 300 is L2, and S2 is greater than L2. By setting S2 to be greater than L2, the lower edge of the air deflector 300 can rotate from the lower edge of the air outlet 110 to the inner side of the air outlet 110, thereby an upper airflow outlet state of the air deflector 300 is achieved. At this moment, the lower edge of the air deflector 300 may be located on the outer side, or on the inner side, or at the lower edge of the air outlet 110.

In an embodiment, S1 is equal to the sum of L1 and a reserved gap, S2 is equal to the sum of L2 and a reserved gap, and the reserved gaps are greater than or equal to 3 mm, and less than or equal to 5 mm. The reserved gaps may be 3 mm, 3.5 mm, 4 mm, 4.5 mm, 5 mm, etc. The reserved gap at the upper edge 111 of the air outlet and the reserved gap at the lower edge 112 of the air outlet may be the same or be different. If the reserved gaps are greater than 5 mm, when the air deflector 300 is in the closed state, a distance between the upper edge 310 of the air deflector and the upper edge of the air outlet and a distance between the lower edge 320 of the air deflector and the lower edge 112 of the air outlet are too large. Therefore, the air leakage can be easily caused, dust is easy to enter the air conditioner, and the appearance is not attractive. If the reserved gaps are less than 3 mm, the air deflector 300 will be heated and expands and deforms at high temperatures or when the air conditioner outputs hot airflow. The air deflector 300 cannot be smoothly rotated to open the air outlet 110, thereby the user complaint is caused. Therefore, by setting the reserved gaps to be greater than or equal to 3 mm and less than or equal to 5 mm, the air deflector 300 can be smoothly opened after being deformed under the high-temperature condition, dust and the like can be effectively prevented from entering the air conditioner, and the overall consistency of the appearance can be kept.

Figure 5:
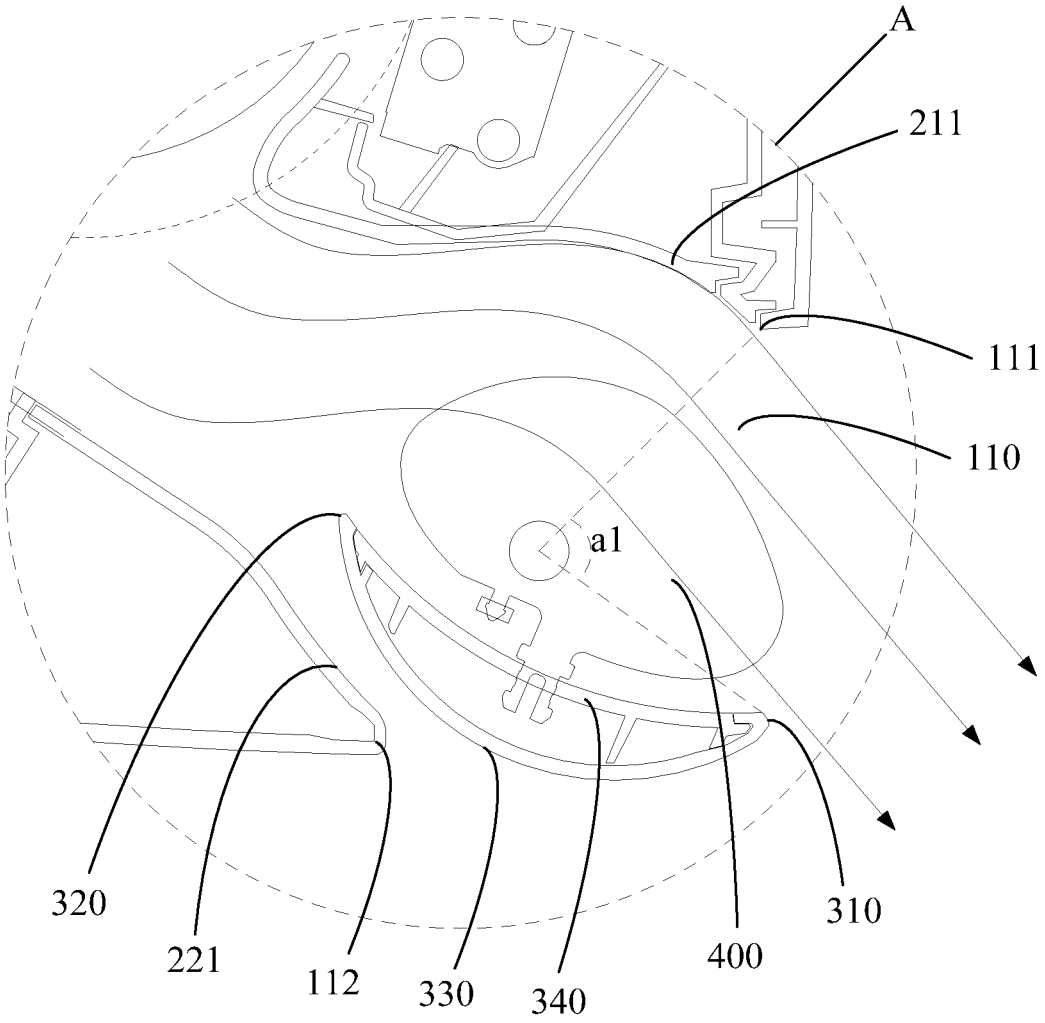
FIG. 5 is a partial enlarged view of portion A in FIG. 3 with an air deflector in a downward-opening state.
Figure 6:
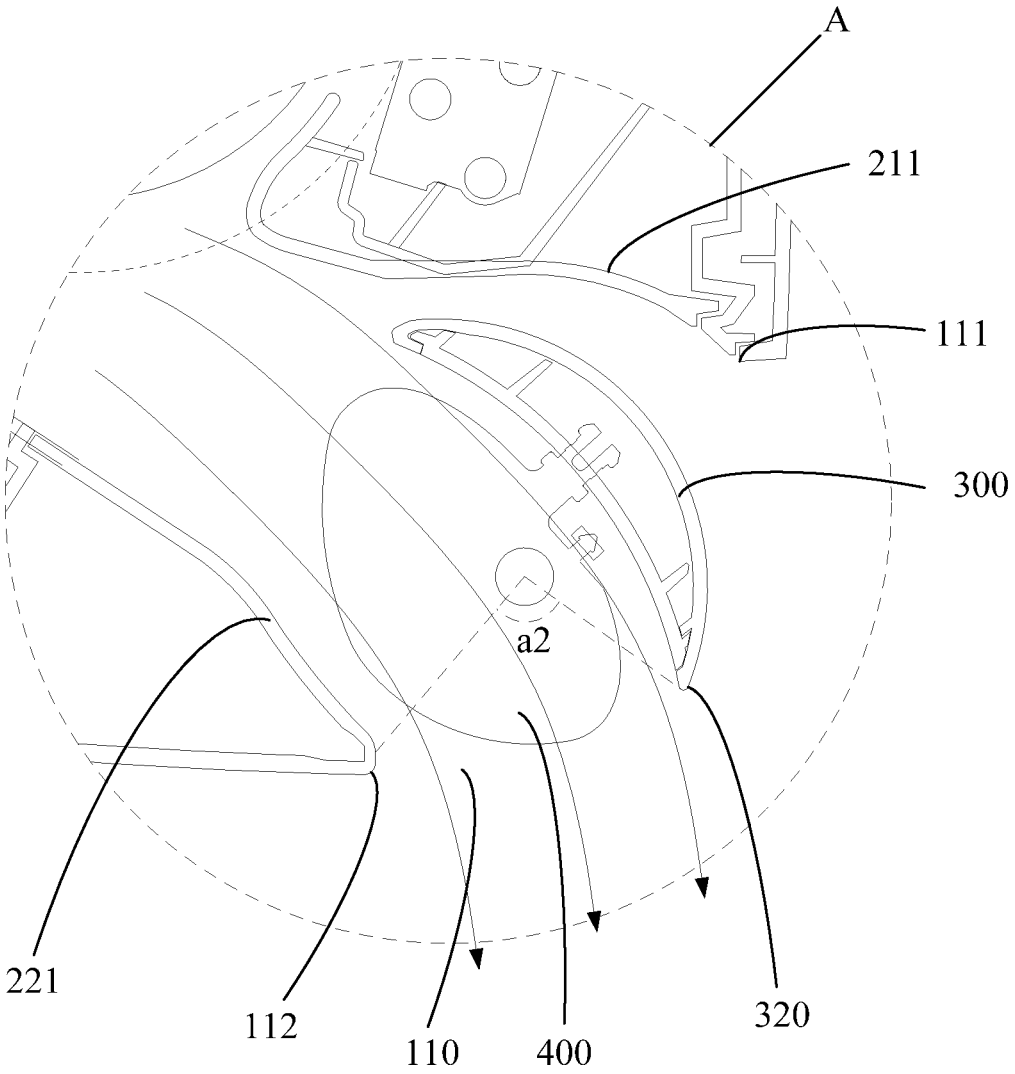
FIG. 6 is a partial enlarged view of portion A in FIG. 3 with the air deflector in an upward-opening state.

In an embodiment, referring to FIG. 5 and FIG. 6, when the air deflector 300 is in the downward-opening state, an included angle between the upper edge 310 of the air deflector 300 and a perpendicular line between the upper edge 111 of the air outlet 110 and the rotation axis of the air deflector 300 (as shown in FIG. 5) is greater than or equal to 57 degrees, and/or when the air deflector 300 is in the upward-opening state, an included angle between the lower edge 320 of the air deflector 300 and a perpendicular line between the lower edge 112 of the air outlet and the rotation axis of the air deflector 300 (as shown in FIG. 6) is greater than or equal to 43 degrees.

In this embodiment, when the air deflector 300 is in the downward-opening state, the included angle between the upper edge 310 of the air deflector and the perpendicular line between the upper edge 111 of the air outlet and the rotation axis of the air deflector 300 is an open angle under the downward-opening state (hereinafter referred to as an upper opening angle). When the air deflector 300 is in the upward-opening state, the included angle between the lower edge 320 of the air deflector and the perpendicular line between the lower edge 112 of the air outlet and the rotation axis of the air deflector 300 is an open angle under the upward-opening state (hereinafter referred to as a lower opening angle). By setting the upper opening angle to be greater than or equal to 57 degrees and the lower opening angle to be greater than or equal to 43 degrees, the angle of the whole air deflector 300 is greater than or equal to 100 degrees, which effectively increases an airflow guiding range of the air deflector 300, and improves the user experience. In practical applications, both the upper opening angle and the lower opening angle may be greater than or equal to 90 degrees, to satisfy multi-angle and large-range airflow supply requirements.

In a preferred embodiment, as shown in FIG. 3 to FIG. 6, the upper volute 210 has an upper arc section 211 connected to the upper edge 111 of the air outlet, and the lower volute 220 has a lower arc section 221 connected to the lower edge 112 of the air outlet. A diameter of the upper arc section 211 is equal to a distance between the upper edge 111 of the air outlet and the rotation axis of the air deflector 300, and a diameter of the lower arc section 221 is equal to a distance between the lower edge 112 of the air outlet and the rotation axis of the air deflector 300.

In this embodiment, the upper volute 210 has an upper arc section 211, and the lower volute 220 has a lower arc section 221. The diameter of the upper arc section 211 is equal to the distance between the upper edge 111 of the air outlet and the rotation axis of the air deflector 300, and the diameter of the lower arc section 221 is equal to the distance between the lower edge 112 of the air outlet and the rotation axis of the air deflector 300. In this way, a smooth arc transition is formed from the upper arc section 211 to the upper edge of the air outlet 110, and a smooth arc transition is formed from the lower arc section 221 to the lower edge of the air outlet 110. Therefore, the air deflector 300 can be switched between the upward-opening state and the downward-opening state more smoothly, the airflow circulation is smoother, and the wind resistance is smaller.

The present application further provides an air conditioner. The air conditioner includes an air conditioner outdoor unit and an air conditioner indoor unit which communicate with each other through a refrigerant pipe. The structure of the air conditioner indoor unit refers to the above embodiments. Since the air conditioner adopts all the technical solutions of all the above embodiments, at least the beneficial effects brought by the above embodiments are provided by the air conditioner, which is not repeated herein.

The above are only preferred embodiments of the present application, and do not limit the scope of the present application. Any equivalent structural transformation made by using the contents of the specification and drawings of the present application or any direct/indirect application in other related technical fields under the inventive concept of the present application is included in the claimed scope of the present application.

What is claimed is:

1. An air conditioner indoor unit comprising:

a housing provided with an air outlet;

a volute assembly provided in the housing and including an upper volute and a lower volute, an air outlet duct communicating with the air outlet being formed between the upper volute and the lower volute;

an air deflector rotatably mounted at the air outlet to open or close the air outlet, and including a peripheral plate and an inner lining plate connected to the peripheral plate, the peripheral plate being in a first arc shape protruding towards an outer side of the air outlet, the inner lining plate being in a second arc shape protruding towards the outer side of the air outlet, two ends of the peripheral plate being connected to two ends of the inner lining plate, respectively, to form a crescent shape, a middle portion of at least one end of the air deflector in a length direction of the air deflector being rotatably connected to the housing through a rotation shaft, to enable the air deflector to rotate between:

an upward-opening state in which a lower side of the air deflector is closer to the upper volute than to the lower volute, and a downward-opening state in which an upper side of the air deflector is closer to the lower volute than to the upper volute; and a louver assembly connected to a windward surface of the air deflector, the louver assembly being rotatably connected to the inner lining plate of the air deflector;

wherein:

a distance between an upper edge of the air deflector and a rotation axis of the air deflector is L1, a distance between a lower edge of the air deflector and the rotation axis of the air deflector is L2;

a distance between an upper edge of the air outlet and the rotation axis of the air deflector is S1, and S1 is equal to a sum of L1 and a first reserved gap;

a distance between a lower edge of the air outlet and the rotation axis of the air deflector is S2, and S2 is equal to a sum of L2 and a second reserved gap, S1 is greater than S2, and L1 is greater than L2; and the first reserved gap is greater than or equal to 3 mm and less than or equal to 5 mm, and the second reserved gap is greater than or equal to 3 mm and less than or equal to 5 mm.

2. The air conditioner indoor unit according to claim 1, wherein the upper edge of the air deflector being an edge of the air deflector closer to the upper volute than to the lower volute when the air outlet is closed by the air deflector.

3. The air conditioner indoor unit according to claim 2, wherein, when the air deflector is in the downward-opening state, an included angle between the upper edge of the air deflector and a perpendicular line between the upper edge of the air outlet and the rotation axis of the air deflector is greater than or equal to 57 degrees.

4. The air conditioner indoor unit according to claim 1, wherein the lower edge of the air deflector being an edge of the air deflector closer to the lower volute than to the upper volute when the air outlet is closed by the air deflector.

5. The air conditioner indoor unit according to claim 4, wherein, when the air deflector is in the upward-opening state, an included angle between the lower edge of the air deflector and a perpendicular line between the lower edge of the air outlet and the rotation axis of the air deflector is greater than or equal to 43 degrees.

6. The air conditioner indoor unit according to claim 1, wherein:

the upper volute includes an upper arc section connected to the upper edge of the air outlet, and a diameter of the upper arc section is equal to the distance from the upper edge of the air outlet to the rotation axis of the air deflector; and the lower volute includes a lower arc section connected to the lower edge of the air outlet, and a diameter of the lower arc section is equal to the distance from the lower edge of the air outlet to the rotation axis of the air deflector.

7. The air conditioner indoor unit according to claim 1, further comprising:

a first driving device and a second driving device mounted at one side of the housing in a length direction of the housing or mounted at two sides, respectively, of the housing in the length direction of the housing;

wherein:

a driving shaft of the first driving device is connected to the air deflector to drive the air deflector to rotate; and the second driving device is in transmission connection with the louver assembly to drive a plurality of louvers of the louver assembly to swing.

8. The air conditioner indoor unit according to claim 1, wherein the air deflector is detachably mounted at the housing.

9. The air conditioner indoor unit according to claim 1, wherein the louver assembly includes a connection rod and a plurality of louvers connected to the connection rod, and the plurality of louvers are arranged at intervals along a length direction of the air deflector.

10. An air conditioner comprising:

an outdoor unit; and an indoor unit communicating with the outdoor unit through a refrigerant pipe, the indoor unit including:

a housing provided with an air outlet;

a volute assembly provided in the housing and including an upper volute and a lower volute, an air outlet duct communicating with the air outlet being formed between the upper volute and the lower volute;

an air deflector rotatably mounted at the air outlet to open or close the air outlet, and including a peripheral plate and an inner lining plate connected to the peripheral plate, the peripheral plate being in a first arc shape protruding towards an outer side of the air outlet, the inner lining plate being in a second arc shape protruding towards the outer side of the air outlet, two ends of the peripheral plate being connected to two ends of the inner lining plate, respectively, to form a crescent shape, a middle portion of at least one end of the air deflector in a length direction of the air deflector being rotatably connected to the housing through a rotation shaft, to enable the air deflector to rotate between:

an upward-opening state in which a lower side of the air deflector is closer to the upper volute than to the lower volute, and a downward-opening state in which an upper side of the air deflector is closer to the lower volute than to the upper volute; and a louver assembly connected to a windward surface of the air deflector, the louver assembly being rotatably connected to the inner lining plate of the air deflector;

wherein:

a distance between an upper edge of the air deflector and a rotation axis of the air deflector is L1, a distance between a lower edge of the air deflector and the rotation axis of the air deflector is L2;

a distance between an upper edge of the air outlet and the rotation axis of the air deflector is S1, and S1 is equal to a sum of L1 and a first reserved gap;

a distance between a lower edge of the air outlet and the rotation axis of the air deflector is S2, and S2 is equal to a sum of L2 and a second reserved gap, S1 is greater than S2, and L1 is greater than L2; and the first reserved gap is greater than or equal to 3 mm and less than or equal to 5 mm, and the second reserved gap is greater than or equal to 3 mm and less than or equal to 5 mm.

11. The air conditioner according to claim 10, wherein the upper edge of the air deflector being an edge of the air deflector closer to the upper volute than to the lower volute when the air outlet is closed by the air deflector.

12. The air conditioner according to claim 10, wherein the lower edge of the air deflector being an edge of the air deflector closer to the lower volute than to the upper volute when the air outlet is closed by the air deflector.

13. The air conditioner according to claim 10, wherein:

the upper volute includes an upper arc section connected to the upper edge of the air outlet, and a diameter of the upper arc section is equal to the distance from the upper edge of the air outlet to the rotation axis of the air deflector; and the lower volute includes a lower arc section connected to the lower edge of the air outlet, and a diameter of the lower arc section is equal to the distance from the lower edge of the air outlet to the rotation axis of the air deflector.

14. The air conditioner according to claim 10, wherein:

the indoor unit further includes a first driving device and a second driving device mounted at one side of the housing in a length direction of the housing or mounted at two sides, respectively, of the housing in the length direction of the housing;

a driving shaft of the first driving device is connected to the air deflector to drive the air deflector to rotate; and the second driving device is in transmission connection with the louver assembly to drive a plurality of louvers of the louver assembly to swing.

15. An air conditioner indoor unit comprising:

a housing provided with an air outlet;

a volute assembly provided in the housing and including an upper volute and a lower volute, an air outlet duct communicating with the air outlet being formed between the upper volute and the lower volute;

an air deflector rotatably mounted at the air outlet to open or close the air outlet, and including a peripheral plate and an inner lining plate connected to the peripheral plate, the peripheral plate being in a first arc shape protruding towards an outer side of the air outlet, the inner lining plate being in a second arc shape protruding towards the outer side of the air outlet, two ends of the peripheral plate being connected to two ends of the inner lining plate, respectively, to form a crescent shape, the first arc shape being not parallel to the second arc shape, a middle portion of at least one end of the air deflector in a length direction of the air deflector being rotatably connected to the housing through a rotation shaft, to enable the air deflector to rotate between:

an upward-opening state in which a lower side of the air deflector is closer to the upper volute than to the lower volute, and a downward-opening state in which an upper side of the air deflector is closer to the lower volute than to the upper volute; and a louver assembly connected to a windward surface of the air deflector, the louver assembly being rotatably connected to the inner lining plate of the air deflector;

wherein:

a distance between an upper edge of the air deflector and a rotation axis of the air deflector is L1, a distance between a lower edge of the air deflector and the rotation axis of the air deflector is L2;

a distance between an upper edge of the air outlet and the rotation axis of the air deflector is S1, and S1 is equal to a sum of L1 and a first reserved gap;

a distance between a lower edge of the air outlet and the rotation axis of the air deflector is S2, and S2 is equal to a sum of L2 and a second reserved gap, S1 is greater than S2, and L1 is greater than L2; and the first reserved gap is greater than or equal to 3 mm and less than or equal to 5 mm, and the second reserved gap is greater than or equal to 3 mm and less than or equal to 5 mm.

* * * * *